US006209848B1

(12) United States Patent
Bolles et al.

(10) Patent No.: US 6,209,848 B1
(45) Date of Patent: Apr. 3, 2001

(54) MOLD FOR PRODUCING MASONRY BLOCK WITH ROUGHENED SURFACE

(75) Inventors: Glenn C. Bolles, Edina; David M. LaCroix, Circle Pines; Ronald J. Scherer, Oak Park Heights, all of MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 09/375,578

(22) Filed: Aug. 17, 1999

(51) Int. Cl.[7] ..... B28B 7/00
(52) U.S. Cl. ..... 249/119; 249/130; 425/443
(58) Field of Search ..... 425/443, 444, 425/413, 358; 249/130, 119

(56) References Cited

U.S. PATENT DOCUMENTS

| | | |
|---|---|---|
| 1,219,127 | 3/1917 | Marshall . |
| 3,919,446 | 11/1975 | Smarook . |
| 3,940,229 | 2/1976 | Hutton . |
| 3,981,953 | 9/1976 | Haines . |
| 4,218,206 | 8/1980 | Mullins . |
| 4,784,821 | 11/1988 | Leopold . |
| 5,062,610 | 11/1991 | Woolford et al. . |
| 5,078,940 | 1/1992 | Sayles . |
| 5,217,630 | 6/1993 | Sayles . |
| 5,249,950 | 10/1993 | Woolford . |
| 5,879,603 | 3/1999 | Sievert . |

*Primary Examiner*—Harold Pyon
*Assistant Examiner*—Emmanuel Luk
(74) *Attorney, Agent, or Firm*—Merchant & Gould PC

(57) ABSTRACT

A mold for producing a masonry unit with a roughened texture side surface having a plurality of side walls defining a mold cavity open at its top and bottom, adapted to receive masonry fill material by way of its open top, and to discharge molded fill material in the form of a block of predetermined height by way of its open bottom; and a wedge-shaped lower lip located along the lower edge of at least one of the side walls, and extending into the mold cavity, the lower lip having grooves formed therein which are oriented at an oblique angle to the general direction of movement of concrete fill material through the mold cavity.

3 Claims, 4 Drawing Sheets

FIG. 3
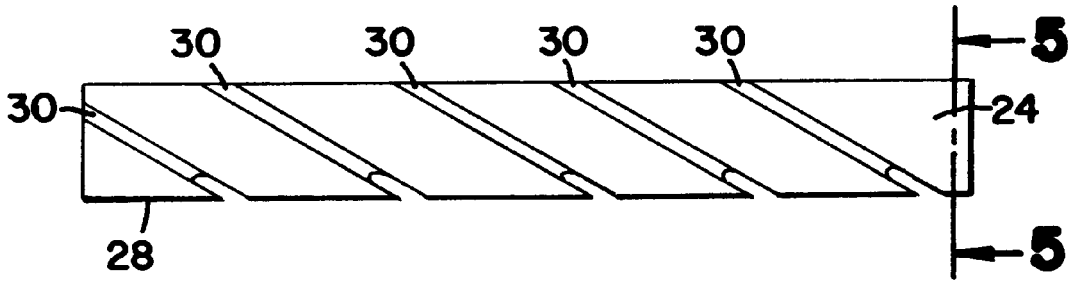
FIG. 4
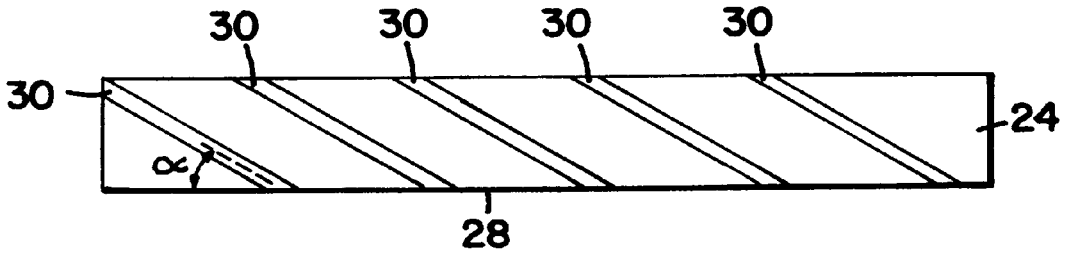
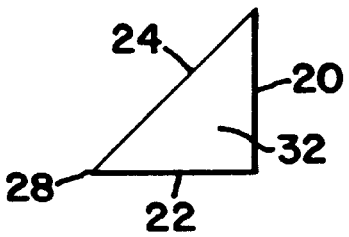
FIG. 5

FIG. 6
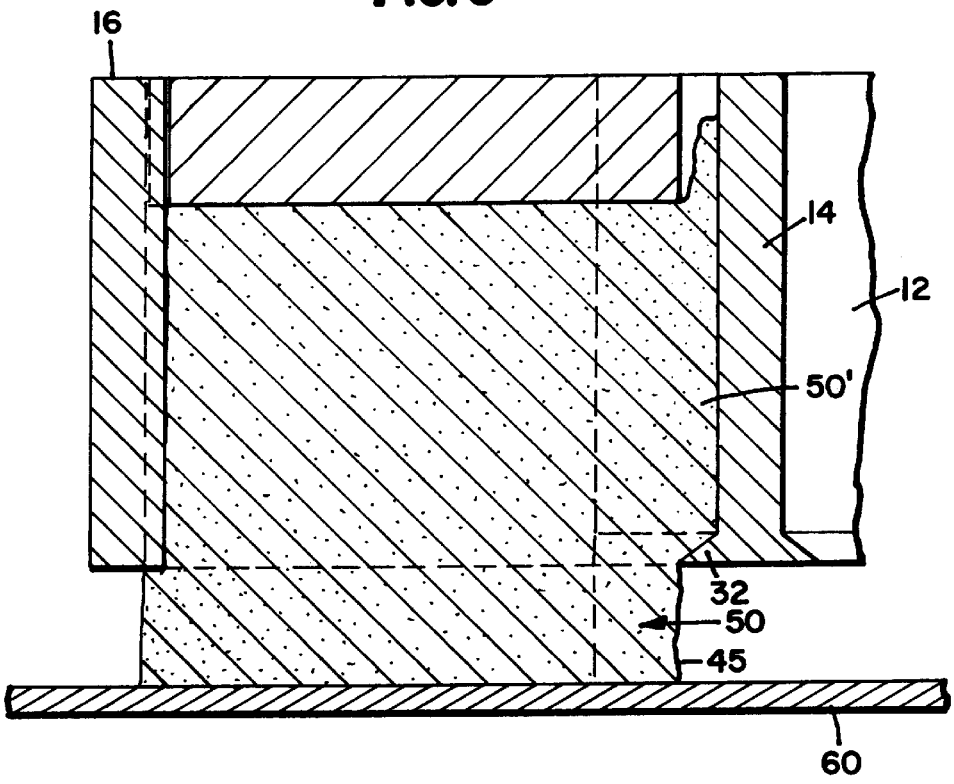
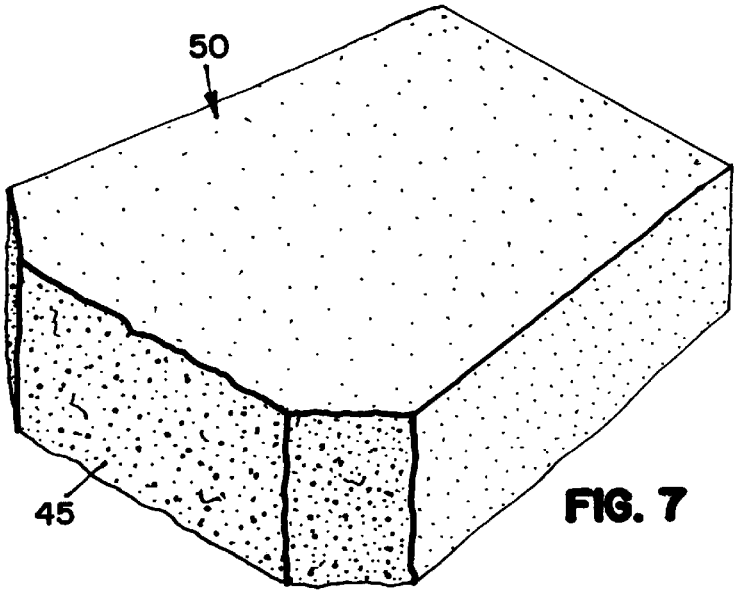
FIG. 7

MOLD FOR PRODUCING MASONRY BLOCK WITH ROUGHENED SURFACE

BACKGROUND OF THE INVENTION

U.S. Pat. No. 3,940,229 describes a mold for making concrete masonry units with a roughened texture on at least one face. The mold has a wall with an inwardly extending lip on the lower edge of the wall. The lip is rectangular in profile, and may be solid or serrated to provide sawtooth-like projections. As the formed concrete unit is forced out of the bottom of the mold, the patent says that the lip produces a scraping or tearing action on the adjacent face of the concrete unit, so as to produce a roughened surface on it. We have experimented with this type of mold, and found that it does produce a roughened surface on the concrete unit, but that the face sometimes has a slight "shingled" appearance.

Angelo Lane Incorporated of Carnegie, Pennsylvania has also, for many years utilized a similar mold to produce a roughened textured face on concrete masonry units. Lane's mold includes a bead of weld material along the lower edge of a mold wall. Generally parallel grooves about one quarter inch wide are ground into the bead at about half-inch intervals. The grooves have been oriented both parallel to the direction of travel of material through the mold, and at an angle thereto.

U.S. Pat. Nos. 5,078,940 and 5,217,630 also describe a mold for making concrete masonry units with a roughened texture on at least one face. The mold described in these patents also employ an inwardly extending lip on the lower edge of at least one wall of the mold. In this case, the lip is wedge-shaped in profile. In addition, the mold includes a plurality of projections above the lip on the same wall and a mesh extending upwardly from the lip generally parallel to the wall and spaced inwardly from the wall. The projections and the mesh are adapted to hold a portion of the concrete fill material against the wall as the formed concrete unit is forced out of the bottom of the mold. As described in these patents, the concrete material held against the mold wall by the projections and the mesh is sheared from the concrete material forced out of the mold, thus forming a roughened surface on the concrete unit forced from the mold. We believe that molds of this design, although without the mesh, have been commercialized under trademark Softsplit. We do not have any direct experience with the Softsplit molds, but understand from those who have used them, that the process must be occasionally interrupted to clean out the material that agglomerates around the projections. This is not necessarily an easy cleaning process. It depends upon how accessible the mold face is to the machine operator. In many of the commonly used concrete block machines, the mold faces are relatively difficult to get at, and safety dictates that precautions such as machine lockouts and the like be used when the cleaning process is undertaken. Unlike this Sofsplit style mold, the mold of the '229 style is self-cleaning. The small amount of material that remains loosely adhered to the lipped mold wall after the mold is stripped is knocked clear of the wall when the next machine pallet is placed against the mold bottom.

U.S. Pat. No. 5,879,603 describes an improvement to the '229 style mold. The '603 patent describes a mold with a wedge-shaped lower lip and an opposed upper lip spaced apart from the lower lip by the distance defining the height of the concrete unit to be produced. The mold acts in a similar fashion to the '229 style mold, but produces less "shingling" effect on the roughened face, and is also self-cleaning in the same fashion: the concrete material that loosely adheres to the mold wall above the lower lip is knocked off the wall when the next pallet is brought into place beneath the mold.

SUMMARY OF THE INVENTION

The present invention is another improvement on the '229 style mold. We have discovered that we can produce a satisfactory roughened surface on a concrete unit by forming grooves in a wedge-shaped lower lip. One embodiment described in the '229 patent includes grooves in the lower lip. The grooves are oriented so that they run in the same direction that the material moves through the mold. In the present invention, the grooves are oriented at an angle to the direction of travel of material. We do not know exactly how these angled grooves are operating within the process, but the units produced seem to have less "shingling" than the units produced by the solid or serrated lips of the '229 patent, and the mold remains self-cleaning.

BRIEF DESCRIPTION OF THE DRAWINGS

FIG. 3 is a top plan view of a portion of the lower lip.

FIG. 4 is a front elevation view of a portion of the lower lip.

FIG. 5 is an enlarged sectional view of the lower lip taken at line 5—5 of FIG. 3.

FIG. 6 is a sectional view of the mold shown in FIG. 2 showing the action of the stripper shoe head compressing the mold fill and stripping the block from the mold.

FIG. 7 is a perspective view of a block made with the process of the invention.

DETAILED DESCRIPTION OF THE INVENTION

Figure 1:
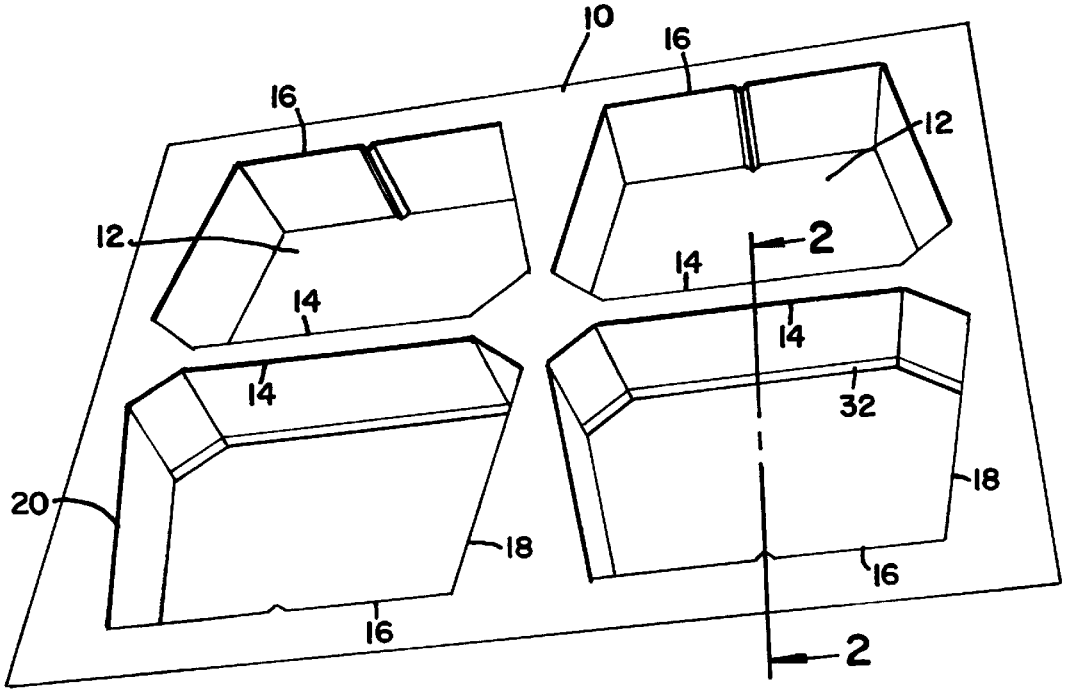
FIG. 1 is a perspective view of a mold.

The invention is a mold for producing a masonry unit or block with a roughened texture on at least one of its side surfaces. The invention may be used with any number of different types of molds to produce any variety of blocks. An example of the mold 10 can be seen in FIG. 1. The mold may have a single cavity 12 or, as can be seen in FIG. 1, multiple cavities. Side walls 14, 16, 18, 20 define the mold cavity 12. The mold is open at its top and bottom.

The mold is adapted by means not shown, but well known to those of ordinary skill in the art, to be mounted in a machine for producing concrete products, such as blocks, slabs, or pavers, from low slump concrete fill material. There are many of these types of machines available. Some of the manufacturers of these machines are Besser, Columbia, Fleming, Tiger, KVM, Masa, Zenith, and Omag.

When the mold is mounted in the machine, a pallet 60 is moved into position under the mold. The pallet is typically a steel or wooden plate. The mold open top allows it to receive concrete fill material up to a predetermined level in the cavity. The mold open bottom allows discharge of the molded fill material. After the mold is filled, the fill material is compacted by vibration and the action of a stripper shoe head plate 40 to a predetermined, compacted level corresponding with the finished height of the finished block.

The mold also comprises a lower lip 32 along at least one of the mold side walls.

Figure 2:
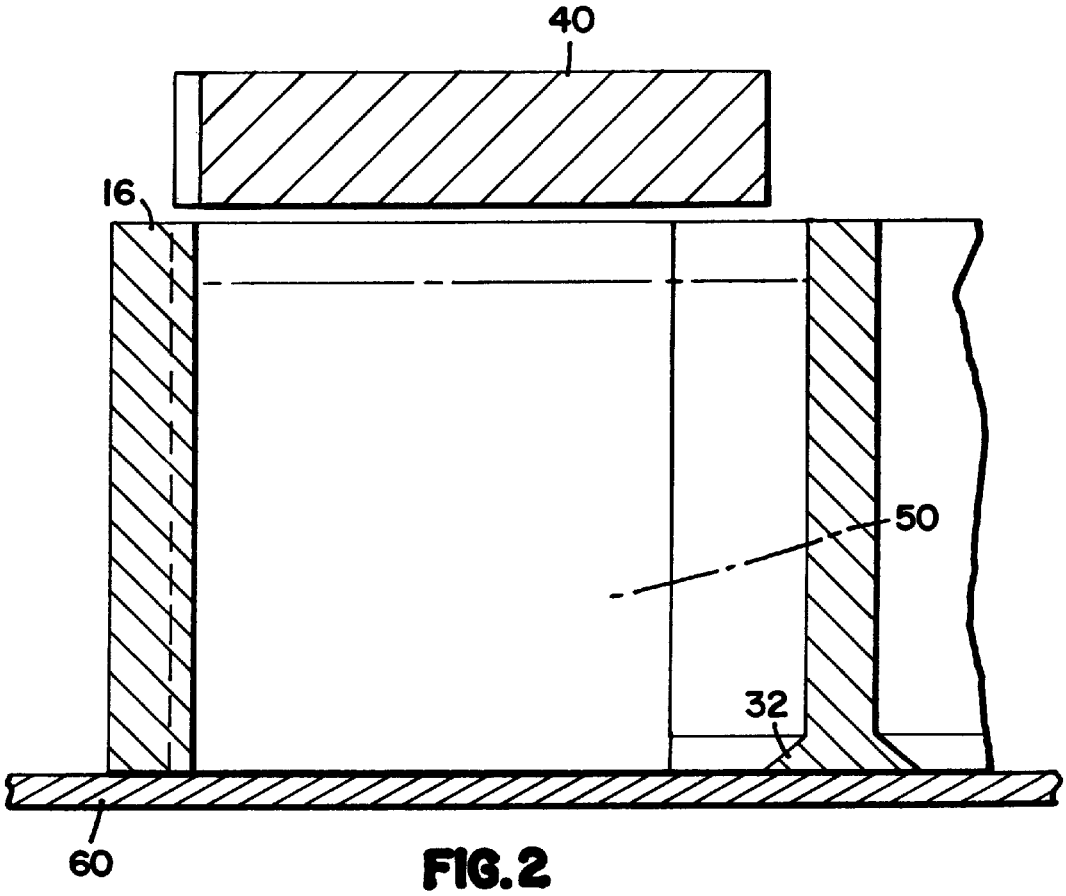
FIG. 2 is a sectional view of the mold shown in FIG. 1 taken at line 2—2, and additionally showing the relationship of the mold to a head plate and a machine pallet.

In the preferred embodiment, the lip 32 is formed along each of the side walls 14. The lower lip 32 is located at the bottom of the mold cavity 12 (FIG. 2), and extends into the cavity.

The shape of the lip in cross section is preferably a wedge, as best shown in FIG. 5. Preferably, the height of the wedge, measured along its back wall 20 is about 3/16 inch. Preferably, the depth of the wedge, measured along is lower wall 22, is also about 3/16 inch. In this configuration, the front face 24 of the lip is oriented at about a 45 degree angle. In this preferred configuration, the lip tapers to a relatively thin leading edge 28. Other lip profiles, such as rectangular, also work.

A plurality of grooves 30 are formed in the lower lip. In the preferred embodiment, the grooves are parallel to each other, and are oriented at an angle a of about 30 degrees from horizontal. They are about 1/16 inch wide, and are spaced about ½ inch apart along the entire length of the lip. The angular orientation of the grooves may vary. They all do not have to be parallel. The dimensions and spacing may also vary. The grooves may extend fully through the lip from the leading edge 28 to the back wall 20. However, in the preferred embodiment of the invention, the grooves are formed in the angled wedge face 24 of the lip, and are about 1/16 of an inch deep. This creates a serrated outboard edge to the lip, with channels running back at an angle along the angled wedge face of the lip from the serrated edge of the lip as shown in FIG. 3.

The lower lip 32 may formed on the side wall 14 by machining. It may also be welded to the side wall. Preferably, however, it is releasably attached to the side wall by means such as bolts, screws, etc. This arrangement allows for relatively easy replacement of the lip, which is important because the lip is a wear point in the mold apparatus and may after time wear, chip or break.

The lower lip of the present invention may also be used in combination with the upper lip described in U.S. Pat. No. 5,879,603, which is incorporated herein by reference.

To use the invention, a machine pallet 60 is brought into position beneath the mold 10, and the mold is filled to a predetermined initial fill level with low slump concrete fill material 50. As is known in the art, low slump concrete fill generally is composed of aggregate such as sand and gravel, cement, and water. It may contain other additives such as color pigment.

Once filled, the mold is vibrated for several seconds, the time necessary to ensure the fill is uniformly spread throughout the mold. This vibrating may occur in concert with the compressive action of the stripper head 40 onto the fill 50 in the mold 10. The combined action of the vibration and the stripper head lowers the level of the fill to a predetermined, compacted level, corresponding with the height of the finished unit.

The pressure applied by the stripper shoe ranges from about 1,000 to 8,000 psi and preferably is about 4,000 psi. Once the compression and vibration period is over the stripper shoe 40 in combination with the underlying pallet 60 acts to strip the blocks from the mold, FIG. 6. The lower lip 32 acts to scrape, tear, or roll fill material in the region of 50' from the remainder of the masonry unit or block at what will become the roughened surface 45 of the block. This provides a masonry unit or block 50 having a roughened surface 45. The roughened texture produced is more or less random in appearance. There may be some shingling, some peaks and valleys, and some interspersed aggregate and pock marks.

Some of the fill material falls onto the pallet 60 as it is scraped off of the masonry unit. Some small amount of the material loosely adheres to the mold side wall 14. This material is knocked off of the wall 14 when a new pallet 60 is brought into place for the next cycle of the machine. Thus, the mold is self-cleaning, and it is not necessary to interrupt production to clear the mold wall 14 of compacted fill material.

Other patents which we know of that are related to block forming include U.S. Pat. Nos. 5,249,950 and 5,062,610 which are both incorporated herein by reference.

Once the blocks are formed they may be cured through any means known to those with skill in the art. Curing mechanisms such as simple air curing, autoclaving, steam curing or mist curing are all useful methods of curing the block resulting from my invention.

The above discussions, examples and embodiments illustrated are current understanding of the invention, however, since many variations of the invention can be made with departing from the spirit and scope of the invention, the invention resides wholly in the claims hereafter appended.

What is claimed is:

1. A mold for producing at least one masonry unit with a roughened texture on at least one face thereof comprising:

a) a plurality of side walls defining a mold cavity open at its top and bottom, which receives masonry fill material by way of its open top, and which discharges molded fill material in the form of a molded masonry unit by way of its open bottom;

b) a lip formed on at least one of said mold side walls, located generally at the bottom of the mold cavity, and extending into the mold cavity;

c) said lip being wedge-shaped in profile to present a leading edge, a back wall at the mold wall, and an angled face to the mold cavity;

d) said angled face including a plurality of grooves formed therein, said grooves extending from the leading edge of the lip backwardly and upwardly on the angled face of the lip, and being of sufficient depth so as to define serrations on the leading edge of the lip;

e) said grooves being oriented at oblique angles to the generally vertical direction of movement of fill material through the mold cavity.

2. The mold of claim 1 wherein the grooves are parallel to each other.

3. The mold of claim 2 wherein the grooves are oriented at about 60 degrees from the general direction of movement of fill material through the mold cavity.

* * * * *